US006412304B1

(12) United States Patent
Adelman

(10) Patent No.: US 6,412,304 B1
(45) Date of Patent: Jul. 2, 2002

(54) JEWELRY

(76) Inventor: Stuart J. Adelman, 925 Fernbrook La. North, Plymouth, MN (US) 55447

( * ) Notice: Subject to any disclaimer, the term of this patent is extended or adjusted under 35 U.S.C. 154(b) by 0 days.

(21) Appl. No.: 09/576,337

(22) Filed: May 22, 2000

Related U.S. Application Data

(60) Provisional application No. 60/135,551, filed on May 24, 1999.

(51) Int. Cl.[7] ..... A44C 17/02

(52) U.S. Cl. ..... 63/26; 63/31; 63/38

(58) Field of Search ..... 63/26, 28, 29.1, 63/31, 38

(56) References Cited

U.S. PATENT DOCUMENTS

| | | | | | |
|---|---|---|---|---|---|
| 915,678 | A | * | 3/1909 | Kantor et al. | 63/31 |
| 1,032,025 | A | * | 7/1912 | Robbins | 63/28 |
| 1,710,734 | A | * | 4/1929 | Johnson | 63/13 |
| 1,894,195 | A | * | 1/1933 | Pulver | 63/28 |
| 1,959,145 | A | * | 5/1934 | Zabriski | 63/15 |
| 2,316,225 | A | * | 4/1943 | Hoffman et al. | 63/29.1 |
| 2,585,183 | A | * | 2/1952 | Stern | 63/15 |
| 4,220,017 | A | * | 9/1980 | Freeman | 63/15 |
| 4,222,245 | A | | 9/1980 | Vitau | 63/28 |
| 4,460,211 | A | | 7/1984 | Pomeroy | 294/99 R |
| 4,543,698 | A | | 10/1985 | Plantureux | 29/10 |
| 4,726,200 | A | * | 2/1988 | Carter | 63/15 |
| 4,813,246 | A | | 3/1989 | Richards | 63/26 |
| 4,821,533 | A | | 4/1989 | Bonnefoy | 63/3 |
| 4,859,827 | A | | 8/1989 | Coyle, Jr. et al. | 219/121.6 |
| 4,970,878 | A | | 11/1990 | Lee | 63/23 |
| 5,285,659 | A | * | 2/1994 | Bardisbanyan | 63/26 |
| 5,690,477 | A | | 11/1997 | Haimoff | 164/9 |
| 5,765,398 | A | | 6/1998 | Bardisbanyan | 63/26 |
| 5,996,374 | A | * | 12/1999 | Bardisbanyan | 63/15 |
| 6,167,726 | B1 | * | 1/2001 | Kremer | 63/31 |
| 6,227,006 | B1 | * | 5/2001 | Pantet | 63/3 |

OTHER PUBLICATIONS

Advertisement from May 1998 issue of "Professional Jeweler" magazine showing laser pierced diamonds.

* cited by examiner

*Primary Examiner*—Jack Lavinder
*Assistant Examiner*—Andrea Chop
(74) *Attorney, Agent, or Firm*—Dorsey & Whitney LLP

(57) ABSTRACT

A method of making jewelry including providing an item to be mounted, creating a throughbore in the item, threading an elongated member through the item, providing a finding, providing a laser, and attaching the elongated member through the item, providing the item is suspended adjacent to the finding. The present invention is intended to encompass the method, the apparatus used to accomplish it, and the piece of jewelry or jewelry design which is produced by the method.

5 Claims, 5 Drawing Sheets

12
28
26
42
20
22
32
24
30

12
44
26
42
36
54
20
22
32
24
30
34
48

12
28
26
42
54
20
22
32
50
52
24
30
34
48

12
44
26
42
54
20
22
38
50
52
24
48

JEWELRY

The present application claims the priority of U.S. provisional patent application, Ser. No. 60/135,551, filed May 24, 1999, which is incorporated herein by reference.

BACKGROUND

Currently, jewelry settings are available in many different types and styles. Among the different sets or settings available are prong sets, bead sets, bezel sets, channel sets, pave settings, and invisible sets. These can be used alone or in combination with each other. There are certain disadvantages to each that the present invention addresses.

Currently, prong setting involves securing a stone between two to six wires (prongs), that extend up from a base that is usually the shape of the stone, oriented on the same axis as the girdle plane of the stone. The prongs are notched to follow the same profile as the stone, so that when the prongs are closed onto the stone, the notched profile forms around the girdle of the stone. The notches are usually anywhere from ⅓ to ½ of the diameter of the prong. The strength of the prong depends on the type of metal, how the metal was heated, how the prong was formed, how the metal was attached to the design, and how much of a notch was cut. The disadvantages to this type of setting are numerous. First, the prongs are notched. The notches weaken the prong, and make it more likely to break. Second, the most common repair on a prong setting is re-tipping, whereby metal or solder is added to the top of a worn down prong. This process only works on heat resistant stones, such as diamonds, rubies, or sapphires that are of sufficient quality so as not to be susceptible to heat expansion stress. If re-tipping will not work, tendency to snag on clothing, and if one or two prongs break or pull away from the stone, the stone will fall out of the setting.

Another type of setting that is currently used is a bead setting. This involves setting a stone into a piece of metal just below the surface by drilling a hole into the metal with a specialized burr that will allow the stone to sit on a seat, so that the table of the stone can be positioned just below the surface. The stone is then secured to the metal by raising a small bead of metal with a steel graver or similar tool, immediately next to the stone until the bead contacts the stone, holding it in the seat. Pave setting uses the same process, except that the stones are set in a broader area, as opposed to traditional bead settings which usually follow a straight line or involve just a single stone. Both bead and pave settings often involve stones of 2.5 mm or less. This setting is very secure. However, the beads still do wear down and can sometimes snag clothing. Also, the stone is essentially buried into the metal, causing 50–60% of the stone to be hidden.

Another type of setting currently used is a bezel setting. A bezel setting is virtually the same as a prong setting, except that the entire perimeter of the stone is covered with a thin ribbon of metal. The bezel is usually a tapered or straight solid tube of an appropriate diameter so as to be able to have a seat burred into it, so that the stone will sit on it with enough left to be pushed, hammered, or otherwise lowered onto the stone to hold it in the bezel. Bezel settings have a smooth edge all around the stone that will not snag, and are very secure. However, this setting technique covers approximately ⅔ of the stone, and the metal will wear down over time.

Yet another type of setting currently used is a channel setting. Channel setting involves setting a stone in a channel between opposing channel walls. A small seat is cut in each channel wall so that the corresponding size stone will sit between the walls, suspended above the base of the channel. The walls are then hammered onto the edge of the stone until the stone is secure. This type of setting most often involves stones of 2.5 mm or less. When larger stones are channel set, they are most often set alone. These stones are at more risk than smaller stones because the channel must be larger, and will be more susceptible to expansion. As with other types of settings, the metal will wear down over time.

Still another type of setting currently used for stones is an invisible setting. An invisible setting is a technique used to set a number of stones together in rows or patterns, so that there is no perceptible means of support. The stones have a very small groove, just under the girdle, on the pavilion. The groove is small enough so as not to be visible from the top, but large enough to accept a thin piece of metal. The stones are grouped together into the particular pattern on top of a lattice form that will accommodate each stone. The metal is then pushed into the grooves of each stone from the back of the lattice, securing the stones to the lattice form. A variation of this technique requires the stones to be notched, much the same way as a tongue and groove arrangement. The perimeter stones are set with metal, while the interior stones of the design are set tongue in groove. This style of setting tends to use smaller stones, usually no larger than 3 mm. Pieces that are invisibly set are more fragile because there is not much metal used to hold the stones in place. In the case of tongue in groove set stones, when one stone falls out, or is broken, the rest of the stones in that grouping will come loose and fall out.

Currently, the shape or cut of the stone will determine, in part, how it is to be set. Most shapes can be set in prongs or bezels, while only rounds and squares can be channel set, only rounds can be bead or pave set, and only squares can be invisibly set. These setting methods are generally used for faceted stones.

Currently and typically, beads and pearls are set using different setting methods than those described above. They usually have a hole drilled into or through them, and are glued to a post, or threaded onto a string or wire. Some stones can also be set this way. For instance, a briolette is a stone that is usually drop shaped. It is usually tapered and conical, and is fully covered with triangular facets. These stones are currently set in one of three ways. The first way is similar to setting a bead or pearl. A small hole is cut partially into the small end of the stone. A metal post is then coated with an adhesive, and inserted into the briolette. The other end of the post can be fashioned into a loop to be suspended from a jewelry design, or attached to a base. Another setting method is to drill a hole through the stone, and pass a wire or cord through the hole, twisting the ends of the wire together and attaching the resulting loop of wire to a jewelry piece. A third method currently used to set these types of stones is to make a cap that covers one end of the briolette, and then attach the cap to a base using an adhesive. A disadvantage of all these types of settings is that adhesives tend to become brittle over time. This will affect the quality of the setting, and the stone could fall off. Another disadvantage is that briolettes that are set by the second method are not set within a mounting structure and do not receive the protection of a setting.

Generally then, current jewelry setting techniques tend to rely on trapping a stone in a metal finding or adhesively connecting a stone to a finding or mounting device. If the stone moves or is loose in the setting, or if the adhesive connection weakens, it is generally considered unsafe. These techniques either end up hiding a portion of the stone, creating a situation where a part of the setting wears out and needs repairs, or have parts that can easily snag on things and break.

What is needed is a jewelry setting method and apparatus, and a jewelry design, that addresses the problems unaddressed or created by current stone and/or jewelry setting techniques by allowing a stone to be almost fully displayed and eliminating the need for parts that can break or need repair, while remaining aesthetically pleasing to the eye.

SUMMARY

The present invention relates to jewelry and, more particularly, to a jewelry design and a method and apparatus for making jewelry, particularly for setting and displaying a gemstone or other decorative object.

In accordance with one embodiment of the invention, a gemstone is displayed substantially without visible support means.

The present invention provides a unique jewelry design and a method for making the design. An advantage of the present invention is that it encompasses virtually any precious and semi-precious stones, and it may be applied more broadly in the decorative and/or ornamental arts. It is well-suited for use on heat-sensitive stones and other heat-sensitive items, including, for example, stones which may be adversely affected at temperatures above about 250 degrees F., laboratory created or grown stones, synthetic stones, imitation stones and the like. Another advantage of the present invention is that it permits the arrangement of precious and/or semi-precious stones in an eye-catching way, increasing the visual appeal and consumer interest in precious and semi-precious gems and gem-stones.

Other features and advantages of the present invention will become more fully apparent and understood with reference to the following description, the accompanying drawings, and the appended claims.

DETAILED DESCRIPTION

The accompanying Figures and this description depict and describe embodiments of the jewelry and method and apparatus of the present invention, and features and components thereof. With regard to means for fastening, mounting, attaching or connecting the components of the present invention to form the jewelry or decorative items as a whole, unless specifically described otherwise, such means are intended to encompass conventional fasteners such as nut and bolt-type connectors, threaded connectors, snap members, clamps and the like, rivets, toggles, pins and the like. Components may also be connected by welding, friction fitting or deformation, if appropriate. Electrical connections, if any, for use in or during the process, may be made using appropriate electrical components and connection methods, including conventional components and connectors. Suitable computers, microprocessors and the like may be used in the method. Unless specifically otherwise disclosed or taught, materials for making components of the present invention are selected from appropriate materials such as metal, metallic alloys, fibers, plastics and the like, and appropriate manufacturing or production methods including casting, extruding, molding and machining may be used.

Any references to front and back, right and left, top and bottom and upper and lower are intended for convenience of description, not to limit the present invention or its components to any one positional or special orientation.

Figure 1:
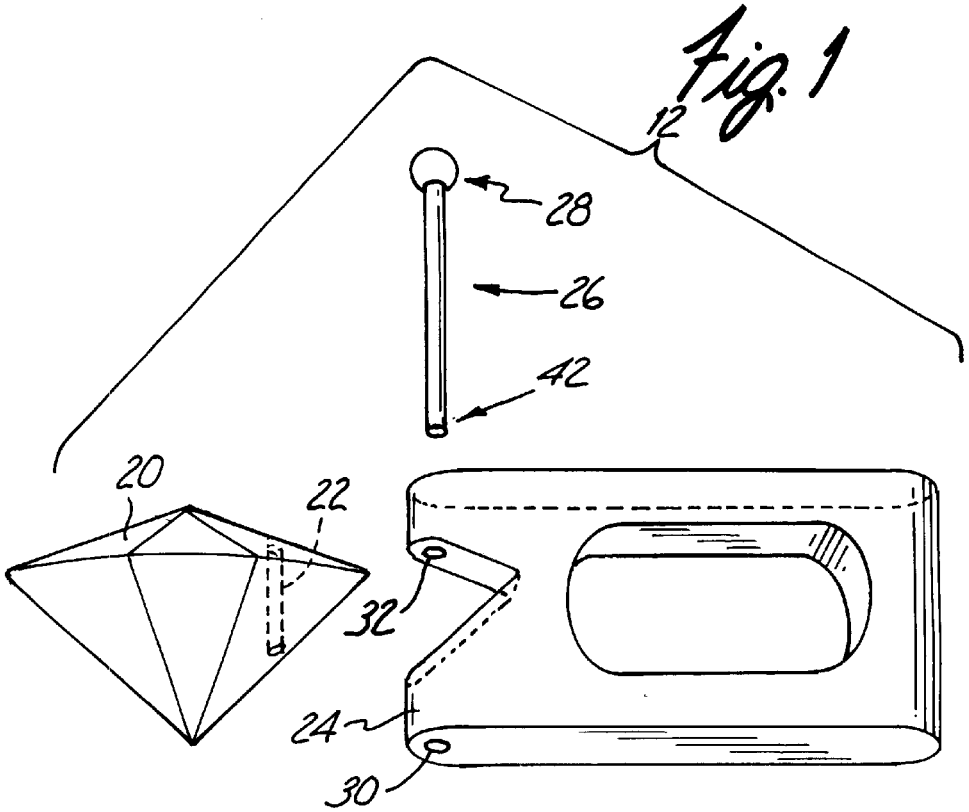
FIG. 1 is a side view of a one embodiment of the invention in an unassembled state.

FIG. 1 depicts one embodiment of the present invention in an unassembled state. A piece of jewelry 12 in accordance with the present invention comprises a finding 24, a mounted item 20, for example, a precious or semi-precious gemstone, and a generally elongated member 26, wherein the mounted item 20 has a throughbore 22 for receiving the elongated member 26, and the finding 24 has apertures 30, 32 for receiving the elongated member 26, whereby the mounted item 20 is suspended adjacent to the finding 24. The piece of jewelry may be worn in any suitable way, e.g., on a chain 46, as a broach, as ring or earing, etc. An advantage of the present invention is that the mounted item 20 may have a degree of freedom of movement relative to the finding 24, thereby enhancing the light gathering and reflecting qualities thereof (particularly in the instance of a precious or semi-precious gemstone).

The throughbore 22 in the item to be mounted 20 may penetrate or pass through the item anywhere, as long as the integrity of the item is not jeopardized. In one embodiment, the throughbore 22 is preferably approximately 1 mm from the edge of the item 20. Similarly, the item 20 to be mounted or coupled to the mounting or finding 24 may be joined thereto in any selected orientation, including adjacent to or in contact with a portion thereof.

Figure 7:
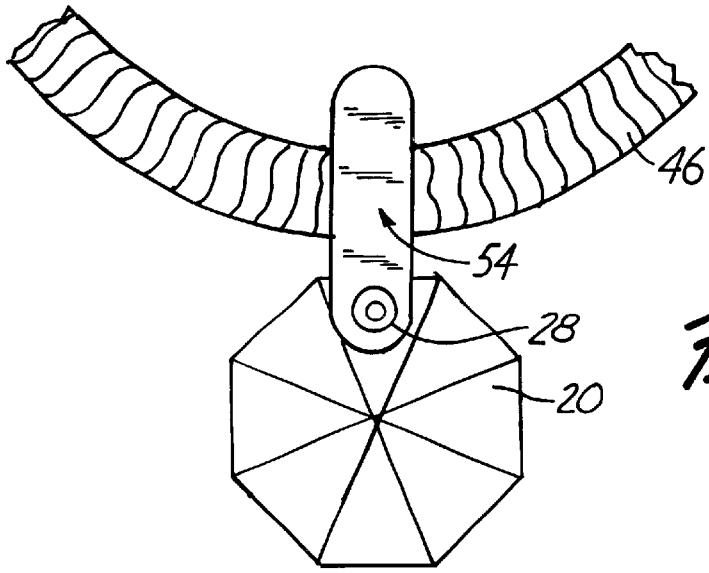
FIG. 7 is a frontal view of the embodiment of the invention depicted in FIG. 1 in an assembled state.
Figure 8:
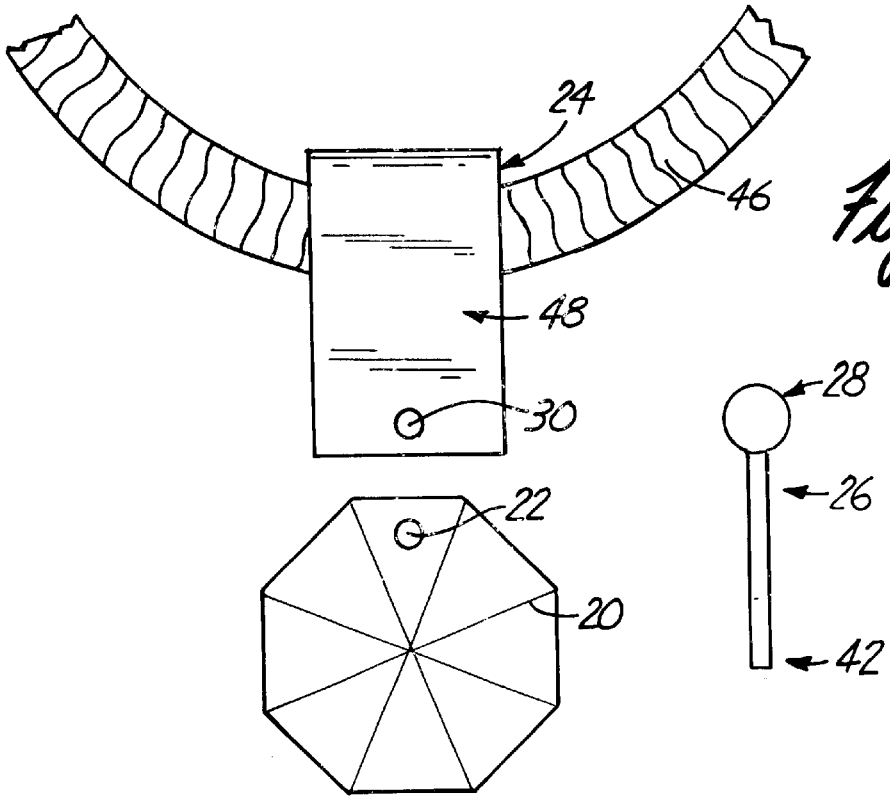
FIG. 8 is a backside view of the embodiment of the invention depicted in FIG. 1 in an unassembled state.
Figure 9:
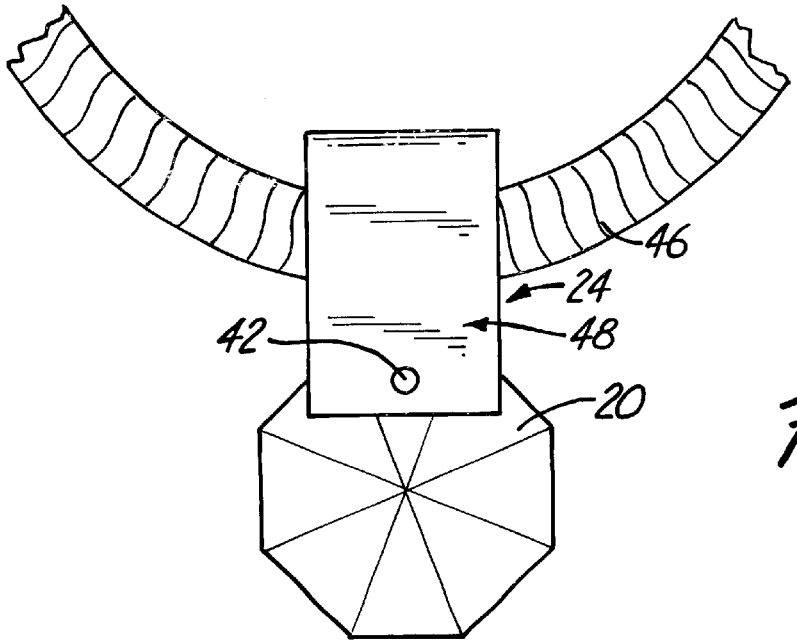
FIG. 9 is a backside view of the embodiment of the invention depicted in FIG. 1 in an assembled state.

The finding 24 can be any jewelry design or item, including but not limited to a pendant, earing, ring, bracelet or the like, made from any precious or non-precious metal capable of withstanding a welding or other heat generating process. The finding 24 is prepared by creating an opening that generally may conform to the profile of the item to be mounted 20. The finding 24 may have any shape, as long as it is able to support the item 20. For instance, the finding 24 may have a triangular shape as shown in FIGS. 1–7. The finding 24 may also have a rectangular shape, as shown in FIGS. 8 and 9. These are for exemplary purposes only, and should not be used to limit the scope of the invention. Any shape finding may be used, as long as the item 20 is able to be attached. In one embodiment, as shown in FIG. 1, the finding 24 has two apertures 30, 32. The apertures 30, 32 serve to accept the elongated member 26.

The elongated member 26 can be formed of any durable material, as long as it is capable of being attached to the finding 24 and can support the item to be mounted 20. The elongated member 26 may be in the form of a flexible wire, such as platinum, gold, or copper, or it may be rigid, such as a steel pin. The elongated member should be generally complementary in size to the throughbore 22 and the apertures 30, 32 and, in most embodiments, may be a single, continuous piece. In some embodiments, the member 26 can be formed of two or more pieces, including, for example, as a chain or chain-like member. In these embodiments, the item or items to be mounted may be provided with two or more bores, some of which may be axially aligned. Preferably, in some embodiments, the elongated member 26 fits snugly into the apertures 30, 32 and relatively loosely in the throughbore 22 to the extent that the mounted item can move freely around the elongated member 26, i.e., so the item can move in two planes about the member, with the movement in some embodiments confined by the finding. In one exemplary embodiment, the elongated member 26 is 22 gauge round platinum wire.

In the embodiment of FIG. 1, the elongated member 26 has two ends 28, 42. A first end 28 carries and is formed to include an anchor 28, which is larger than the diameter of the aperture 32, to prevent the elongated member 26 from passing totally through the aperture-throughbore arrangement. The second end 42 is attached or secured to the finding 24 after being passed through aperture 30. With the anchor 28 on one end, and the other end 42 attached to the finding, the elongated member 26 holds the item 20 to the finding 24.

Figure 5:
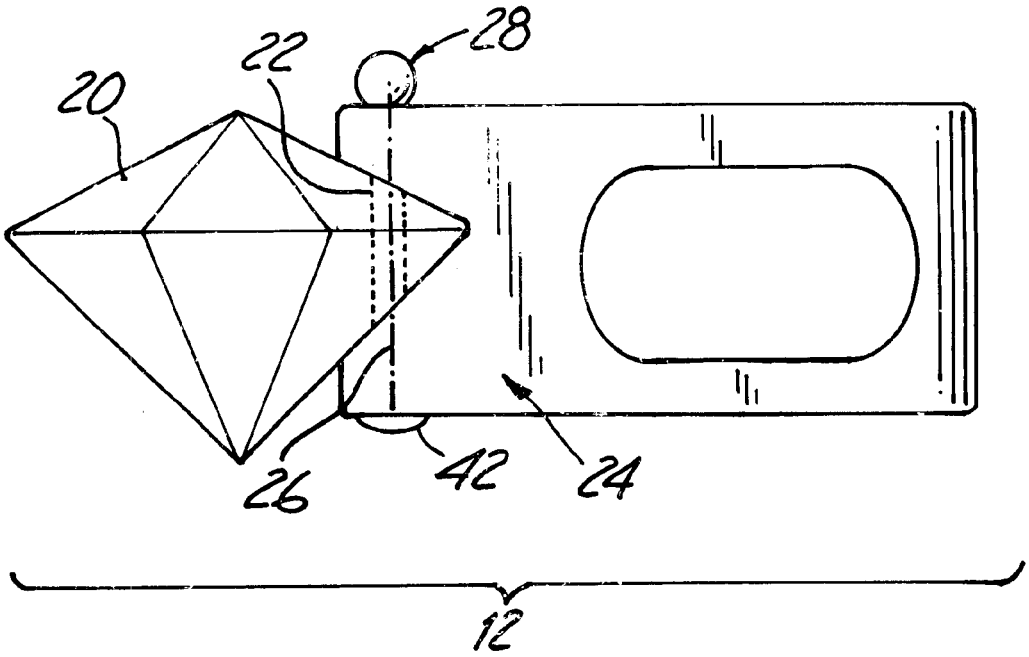
FIG. 5 is a side view of the embodiment of the invention depicted in FIG. 1 in an assembled state.

FIG. 5 shows the embodiment of the invention depicted in FIG. 1 from a side view in an assembled state. The item 20 is attached to the finding 24 by the elongated member 26. The elongated member has been passed through the first aperture 32, through the throughbore 22, and through the second aperture 30. The elongated member 26 is held in place by the anchor end 28, the second end 42 being attached to the backside of the finding 24.

Figure 6:
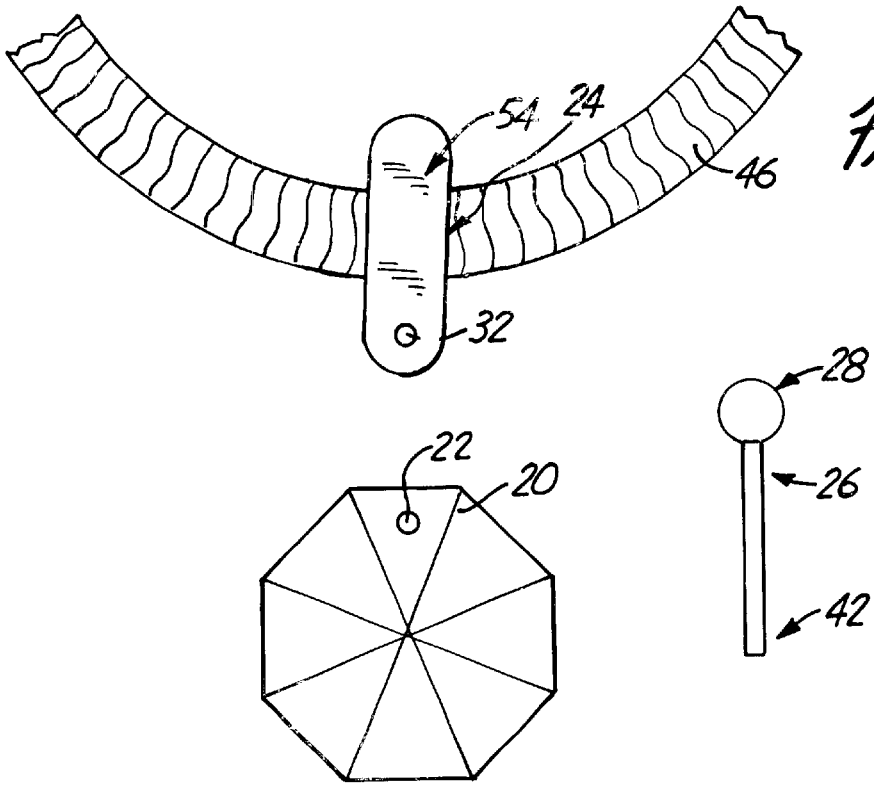
FIG. 6 is a frontal view of the embodiment of the invention depicted in FIG. 1 in an unassembled state.

FIG. 6 depicts the embodiment of the invention depicted in FIG. 1 from a frontal view in an unassembled state. In this example, the finding 24 is a piece of jewelry that is suspended from a necklace 46. The use of a necklace is for exemplary purposes only, and should not be interpreted to confine the scope of the invention. FIG. 7 depicts the embodiment of the present invention of FIG. 1 from a frontal view in an assembled state. As can be seen, a majority of the item 20 is visibly displayed, and is free to rotate on the axis created by the elongated member 26 (not visible in this Figure). This enhances the ability of the item 20 to catch and reflect light and enhances the visual appeal of the item.

FIGS. 8 and 9 depict a rear view of the embodiment of the invention depicted in FIG. 1. These figures also show the finding 24 being a piece of jewelry that is suspended from a necklace 46. The use of a necklace is for exemplary purposes only, and should not restrict the scope of the invention. FIG. 8 depicts the piece of jewelry 12 of the present invention in an unassembled state, and FIG. 9 depicts the piece of jewelry 12 of the present invention in an assembled state.

Figure 2:
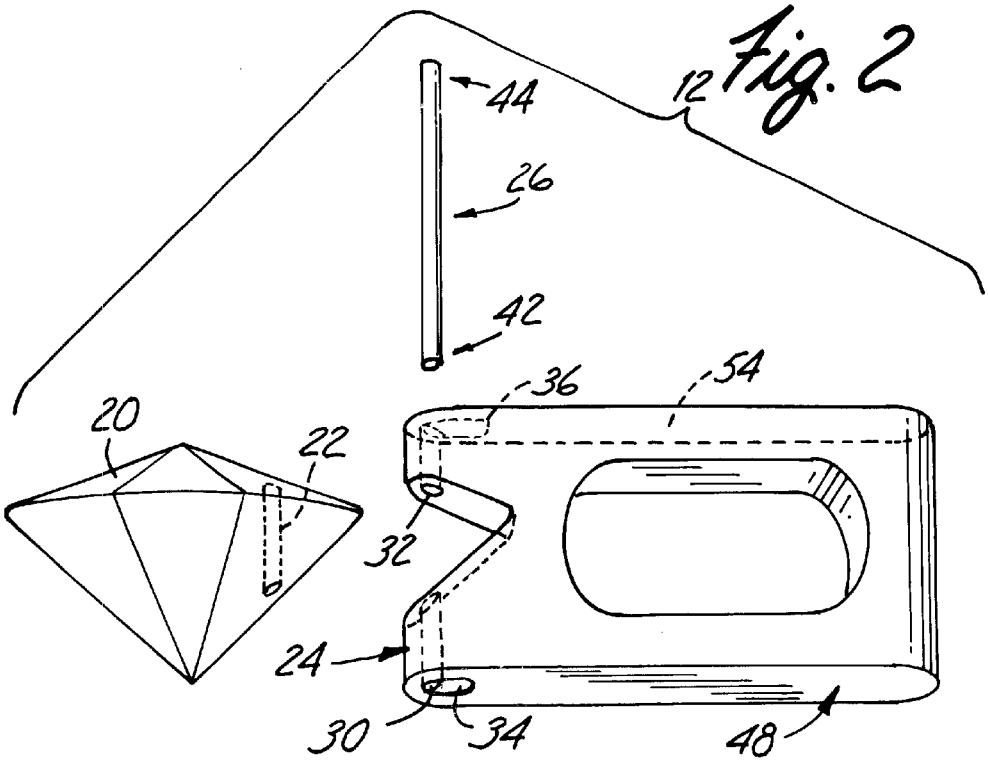
FIG. 2 is a side view of another embodiment of the invention in an unassembled state.
Figure 3:
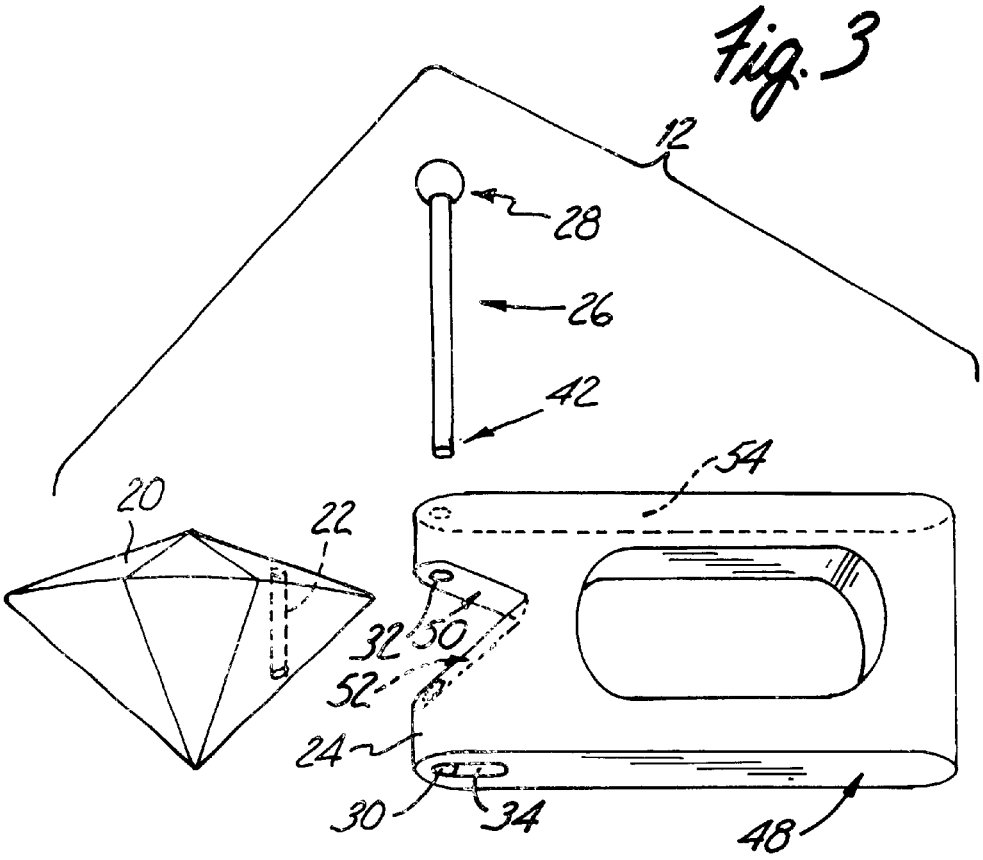
FIG. 3 is a side view of another embodiment of the invention in an unassembled state.
Figure 4:
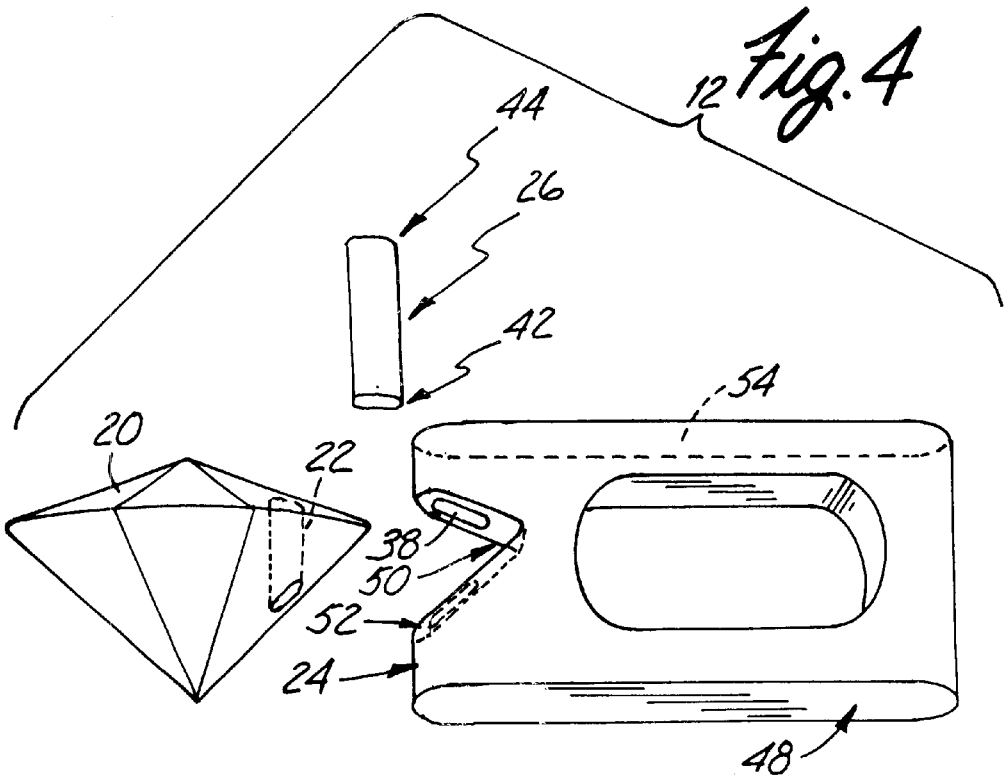
FIG. 4 is a side view of another embodiment of the invention in an unassembled state.

FIGS. 2, 3, and 4 depict alternative embodiments of the jewelry and mounting method of the present invention. Features common to various embodiments are commonly numbered. FIG. 2 shows the finding 24 having two channels 34, 36 on opposite outside edges 48, 54 of the finding 24. These channels are suitably formed in the finding and are directly adjacent to the apertures 30, 32. Channel 36 is shown in phantom, and is similar and proportional to channel 34 which is shown in the Figure. The channels can be any length, and should have dimensions to generally accept the ends 42, 44 of the elongated member 26. Preferably, the channels are cut so that they are approximately 1 mm in length, and have dimensions just large enough to accept the ends 42, 44 of the elongated member 26. The ends 42 and 44 of the elongated member 26 are attached to the finding 24 in the channels 34, 36, and set the item 20 in the finding 24.

FIG. 3 depicts another embodiment of the invention. In this embodiment, a channel 34 is formed in the outside edge 48 of the finding 24 adjacent to aperture 30. The channel 34 can be any length, and should have dimensions to accept the end 42 of the elongated member 26. Preferably, the channel is approximately 1 mm long, and has dimensions just large enough to accept the elongated member 26. The front edge of the finding 24 does not have a channel and the elongated member 26 has an anchor 28 on one end that is larger than the diameter of aperture 32. The item to be mounted 20 is held in place by the elongated member 26, which is attached to the finding 24 by the anchor 38 at one end, and by attaching the other end 42 to the channel by welding or other suitable method.

FIG. 4 shows another embodiment of the invention. In this embodiment, there are no apertures in the finding 24. There are two channels 38, 40 cut into the inside edges 50, 52 of the finding 24. These channels can be any length, and should have dimensions to accept the ends 42, 44 of the elongated member 26. Preferably, the channels 42, 44 are approximately 1 mm in length, and have dimensions just large enough to accept the ends 42, 44 of the elongated member 26. The two ends 42, 44 of the elongated member are attached to the finding 24 at the channel sites by welding or other suitable method.

In other embodiments of the invention (not shown), there may be no apertures and no channels in the finding 24, the ends. 42, 44 of the elongated member 26 being attached to the inside edges 50, 52 of the finding 24 by welding or other suitable methods.

To make the jewelry of the present invention, an item to be mounted 20 is first provided with a throughbore 22. The throughbore 22 is made in the item using a device capable of creating such a throughbore 22 in the item to be mounted 20. In one embodiment, a laser may be used to create the throughbore 22. In other embodiments, an ultrasonic drill may be used. The item to be mounted, i.e., the material thereof, may dictate which device is used to create the throughbore 22. For very hard stones or minerals, such as diamonds, a laser may be used, and for stones or minerals of a slightly less hardness factor, such as rubies and sapphires, a laser or an ultrasonic drill may be used. One skilled in the art will appreciate that, depending on the item to be mounted 20, different devices can be used to create the throughbore 22. The throughbore 22 should have a diameter large enough to accept the elongated member 26. Preferably, the diameter of the throughbore 22 is just large enough to accept the elongated member 26, in order to allow the mounted item to move freely. The throughbore 22 may be located anywhere near the edge of the item 20. Preferably, the throughbore 22 may be located approximately 1 mm from the edge of the item 20.

An elongated member 26 having two ends 28, 42 is then provided. As explained above, the elongated member 26 is any durable member capable of forming and/or supporting the item 20, and capable of being attached to the finding 24. In any embodiment where the elongated member 26 has an anchor 28 on one end, the elongated member 26 should also be capable of supporting the anchor 28. The elongated member 26 in one embodiment is 22 gauge platinum wire. In one embodiment, the anchor 28 is formed by heating one end of the elongated member 26 until a ball forms that is approximately twice the diameter of the elongated member. Any sort of heating device, such as a laser, soldering iron, or electric welder may be used, as long as the heating device is capable of heating up the elongated member 26 to the point of forming a ball 28 on its end.

A finding 24 is then provided. The finding 24 can be any jewelry design (e.g., mounting device, piece(s) of jewelry and the like) made from any precious or non-precious metal or material capable of undergoing a welding or heating process, including laser welding. In the some embodiments, the finding is gold. The finding 24 may have an opening that generally conforms to the profile of the item to be mounted 20, but it may have a differently shaped opening as well. In one embodiment, two apertures 30, 32 are drilled into the sides of the finding 24, one on each side. The apertures 30, 32 may be created with a laser, an ultrasonic drill, or any other device capable of creating an aperture in the finding 24 without damaging. The diameter of the apertures 30, 32 is large enough to accept the elongated member 26. Preferably, the diameters of the apertures 30, 32 are just large enough to allow the elongated member 26 to pass through.

The item 20 with the throughbore 22 is then positioned in the opening in the finding 24 so that the throughbore 22 and the apertures 30, 32 are adjacent and aligned. The end of the elongated member 26 without the anchor 42 is inserted into the first aperture 32, through the throughbore 22, and through the second aperture 30. The elongated member 26 is extended through the aligned apertures and throughbore until the anchor 28 abuts the outside edge of the finding 24. The end of the elongated member 26 without the anchor 42 should then protrude from the aperture 30. A pliers, or other suitable crimping tool, is used to squeeze the end 42 of the elongated member 26, so that it deforms. The end 42 of the elongated member 26 is then either cut off or broken off so that a short length of the end 42 of the elongated member 26 is protruding from the aperture 30. In one embodiment, the length of the protruding ends 42, 44 of the elongated member 26 is approximately 1.5 mm. A laser may then be used to weld or connect the protruding end 42 of the elongated member 26 to the finding 26. The laser welds the elongated member 26 to the finding 24 through the aperture 30 and on the outside edge of the finding 24. Any laser that can sufficiently heat and deform the end 42 of the elongated member 26 may be used, as long as it can perform that function without damaging the finding 24 or the mounted item 22. In one embodiment, a neodymium: yttrium aluminum garnet pulse laser is used. The welding process may result in a bump on the outside edge of the finding 24; the bump may be smoothed and polished. The resulting piece of jewelry (which also may be referred to as a jewelry apparatus), includes an item permanently set in a finding, wherein substantially all of the item is displayed or visible, wherein it has the ability to pivot and catch light, and wherein the piece of jewelry, particularly the mounts or finding, does not have the potential to wear down or snag on clothing.

In another embodiment of the invention, no anchor 28 is created on the elongated member 26. Instead, two channels 34, 36 are formed into the outside edges 48, 54 of the finding 24 adjacent to the apertures 30, 32. Preferably, the channels are approximately 1 mm long, and are just large enough to accept the elongated member 26. The item 20 with the throughbore 22 is then aligned in the finding 24 with the apertures 30, 32. One end of the elongated member 26 is inserted into one of the apertures (it doesn't matter which one), through the throughbore 22, and through the other aperture, so that there is a portion of the elongated member 26 protruding out of each aperture 30, 32. The two ends of the elongated member 26 are then cut or broken, so that just enough of the elongated member 26 is protruding from each aperture may be crimped into the channels 34, 36. The ends of the elongated member 26 are then crimped into the channels 34, 36 using a crimping pliers or other suitable device. The ends of the elongated member are then welded into the channels to make a permanent connection, and the welds or joints may be smoothed and/or polished.

Another embodiment of the invention combines previously described embodiments. The finding has a channel 34 cut into the backside 48 of the finding 24 adjacent to aperture 30. There is no channel adjacent to aperture 32. An anchor 28 is formed on the end of the elongated member 26 as was described above. The item 20 with the throughbore 22 is placed in contact with the finding 24, so that the apertures 30, 32 are aligned with the throughbore 22. The second end 42 of the elongated member is inserted into aperture 32, through the throughbore 22, and through aperture 30, until the anchor 28 abuts the outside edge of the finding 24, so that a length of the end 42 of the elongated member 26 is protruding out from the finding 24. The end 42 of the elongated member 26 is then cut or broken off, so that only a length of the elongated member 26 remains protruding that will fit into the channel 34. The protruding end 42 of the elongated member 26 is then crimped into the channel using a crimping pliers or some other device. The end 42 of the elongated member is then laser welded into the channel 34, to make a permanent connection. The welded joint is then smoothed and polished.

In another embodiment of the invention, a finding is provided with no apertures, and two channels 38, 40 cut into the inside edges 50, 52 of the finding 24. An item 20 is provided with a throughbore 22 as described above. An elongated member 26 is provided, which is inserted through the throughbore 22, so that the two ends of the elongated member 26 are protruding from the ends of the throughbore 22. The protruding ends of the elongated member 26 are cut or broken so that enough length of elongated member 26 is protruding from each end of the throughbore 22 to fit into the channels 38, 40. The item 20 is then brought into contact with the finding 24 so that the protruding ends of the elongated member 26 are in contact with the channels 38, 40. The ends of the elongated member 26 are then crimped into the channels 38, 40 using a crimping pliers or some other suitable device. The ends of the elongated member 26 are then laser welded to the channels to create a permanent connection. Another embodiment of the invention is similar, except that there are no channels cut into the finding 24. The ends of the elongated member 26 protruding from the throughbore 22 are brought into connection with the inside edges 50, 52 of the finding 24, where they are welded to the finding.

The advantage to using a laser in the process of the present invention is that most colored gemstones cannot withstand the heat required to weld, fuse or solder together two metals. Thus, the present invention is well-suited for use wherein said item to be mounted is selected from a group consisting of heat-sensitive items. The concentrated laser pulse is hot enough and concentrated enough to melt and fuse the materials in the finding 24 and elongated member 26 together, but it does not overheat fragile gemstones. During the laser welding process, the entire piece can be held between the fingertips, and little cleanup is necessary following the process, further protecting the gemstone from the harsh chemicals and heat normally used for the cleanup of conventionally welded or soldered jewelry.

A microprocessor may be used in the processing or fabrication of jewelry in accordance with the present invention, particularly for batch processing. For example, a microprocessor may be used in forming the mountings or findings for use in the present invention, and/or in other steps of the method such as the drilling of stones or objects to be mounted, or to operate or control the laser. Other suitable processing unit(s) and peripheral devices may be used as well. For example, the operation and control of the laser could be accomplished under the control of a suitable microprocessor. The program logic could be either hardware, software, or a combination of both.

The present invention may be embodied in other specific forms without departing from the essential spirit or attributes thereof. It is desired that the described embodiments be considered in all respects as illustrative, not restrictive.

I claim:

1. A piece of jewelry comprising:

a finding, wherein said finding has a first and second aperture;

a first channel on said finding, said first channel being immediately adjacent to and connected to said first aperture;

a gemstone having a throughbore, and movably connected to said finding, wherein the gemstone has a degree of freedom of movement relative to the finding; and an elongated member with two ends and a length, each of said apertures having a diameter sufficient to accept said elongated member, a portion of said length in said throughbore and the two ends connected to said finding, wherein more than one half of the gemstone is displayed substantially without visible support.

2. The piece of jewelry in claim 1, wherein said throughbore has a diameter large enough to accept said elongated member.

3. The piece of jewelry in claim 1, further comprising a second channel on said finding, whereby said second channel is immediately adjacent to and connected to said second aperture.

4. The piece of jewelry in claim 1, wherein said gemstone is selected from the group consisting of: precious stones, semi-precious stones, non-precious stones, and ornamental pieces.

5. The piece of jewelry in claim 1, wherein said elongated member is a durable wire.

* * * * *